US007043817B2

(12) United States Patent
Powell et al.

(10) Patent No.: US 7,043,817 B2
(45) Date of Patent: May 16, 2006

(54) METHOD OF ALIGNING SCROLL COMPRESSOR PUMP CARTRIDGE

(75) Inventors: Michael P. Powell, Arkadelphia, AR (US); Edward A. Tomayko, Arkadelphia, AR (US); Carlos A. Zamudio, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 294 days.

(21) Appl. No.: 10/677,202

(22) Filed: Oct. 2, 2003

(65) Prior Publication Data

US 2005/0071981 A1 Apr. 7, 2005

(51) Int. Cl.
*B23Q 3/00* (2006.01)
*B23P 15/00* (2006.01)

(52) U.S. Cl. ..... 29/464; 29/466; 29/888.022

(58) Field of Classification Search ..... 29/464, 29/466, 888.022
See application file for complete search history.

(56) References Cited

U.S. PATENT DOCUMENTS

| | | | | |
|---|---|---|---|---|
| 4,655,697 | A | 4/1987 | Nakamura | |
| 6,056,524 | A * | 5/2000 | Williams et al. | 418/55.1 |
| 6,241,495 | B1 | 6/2001 | Chang | |
| 6,280,165 | B1 * | 8/2001 | Tsuchiya et al. | 418/55.1 |

FOREIGN PATENT DOCUMENTS

| | | |
|---|---|---|
| EP | 0 341 407 A3 | 3/1989 |
| EP | 0 890 744 A3 | 2/2000 |
| GB | 2346935 A | 8/2000 |

* cited by examiner

*Primary Examiner*—Marc Jimenez
*Assistant Examiner*—Christopher M. Koehler
(74) *Attorney, Agent, or Firm*—Carlson, Gaskey & Olds

(57) ABSTRACT

A method of aligning a crankcase to a non-orbiting scroll includes the steps of forming initial alignment surfaces on both the non-orbiting scroll and the crankcase. Further, when the non-orbiting scroll and the crankcase are machined, precision drilled holes are drilled into each of the two. These holes are drilled relative to datum surfaces on both the non-orbiting scroll and the crankcase. Thus, once the two have been pre-positioned, the precision drilled holes are aligned and a threaded bolt is inserted into the precision drilled holes. The threaded bolt ensures that the two will be radially positioned properly relative to each other.

4 Claims, 3 Drawing Sheets

METHOD OF ALIGNING SCROLL COMPRESSOR PUMP CARTRIDGE

BACKGROUND OF THE INVENTION

This invention relates to a simplified method of properly aligning the fixed scroll relative to the supporting crankcase that utilizes a precision drilled alignment hole.

Scroll compressors are becoming widely utilized in refrigerant compression applications. In a typical scroll compressor, first and second scroll members each have a base and a generally spiral wrap extending from the base. The wraps interfit to define compression chambers. One of the two scroll members is caused to orbit relative to the other. The other may be fixed. As the wraps orbit relative to each other, a refrigerant entrapped between the wraps is compressed.

A crankcase typically supports the scroll member which is driven to orbit. A non-rotation coupling, typically known as an Oldham coupling is received between the crankcase and the orbiting scroll member. A slot for receiving a portion of the Oldham coupling is precision machined.

In a known type of scroll compressor, the non-orbiting scroll member must be positioned accurately relative to the crankcase. By properly positioning the fixed scroll relative to the crankcase, it is ensured that the non-rotation coupling is properly positioned relative to the fixed scroll. In this way, the wrap of a fixed scroll is properly positioned relative to the orbiting movement of the orbiting scroll.

In the prior art, assembling the fixed scroll to the crankcase has typically required a complex gauging assembly which often breaks. When the gauging assembly breaks, there is a significant amount of down time. Moreover, even when the gauging assembly is operating properly, the prior art utilized a long process to properly orientate the two members.

SUMMARY OF THE INVENTION

In the disclosed embodiment of this invention, a simplified way of properly orientating the fixed scroll to the crankcase, and hence to the orbiting scroll is developed. Essentially, the fixed scroll and crankcase are formed with interlocking members which properly position the two members relative to each other in an x-y plane. Further, a precision hole is drilled through each of the two members when they are machined. The precision hole is drilled relative to a datum on both the fixed scroll and the crankcase such that the holes will be properly positioned relative to the datum such that when they are aligned, it is ensured that the fixed scroll and crankcase are properly orientated relative to each other.

In the above fashion, a very simple way of assembling the two members, and ensuring they are properly positioned, is obtained.

These and other features of the present invention can be best understood from the following specification and drawings, the following of which is a brief description.

DETAILED DESCRIPTION OF THE PREFERRED EMBODIMENT

Figure 1:
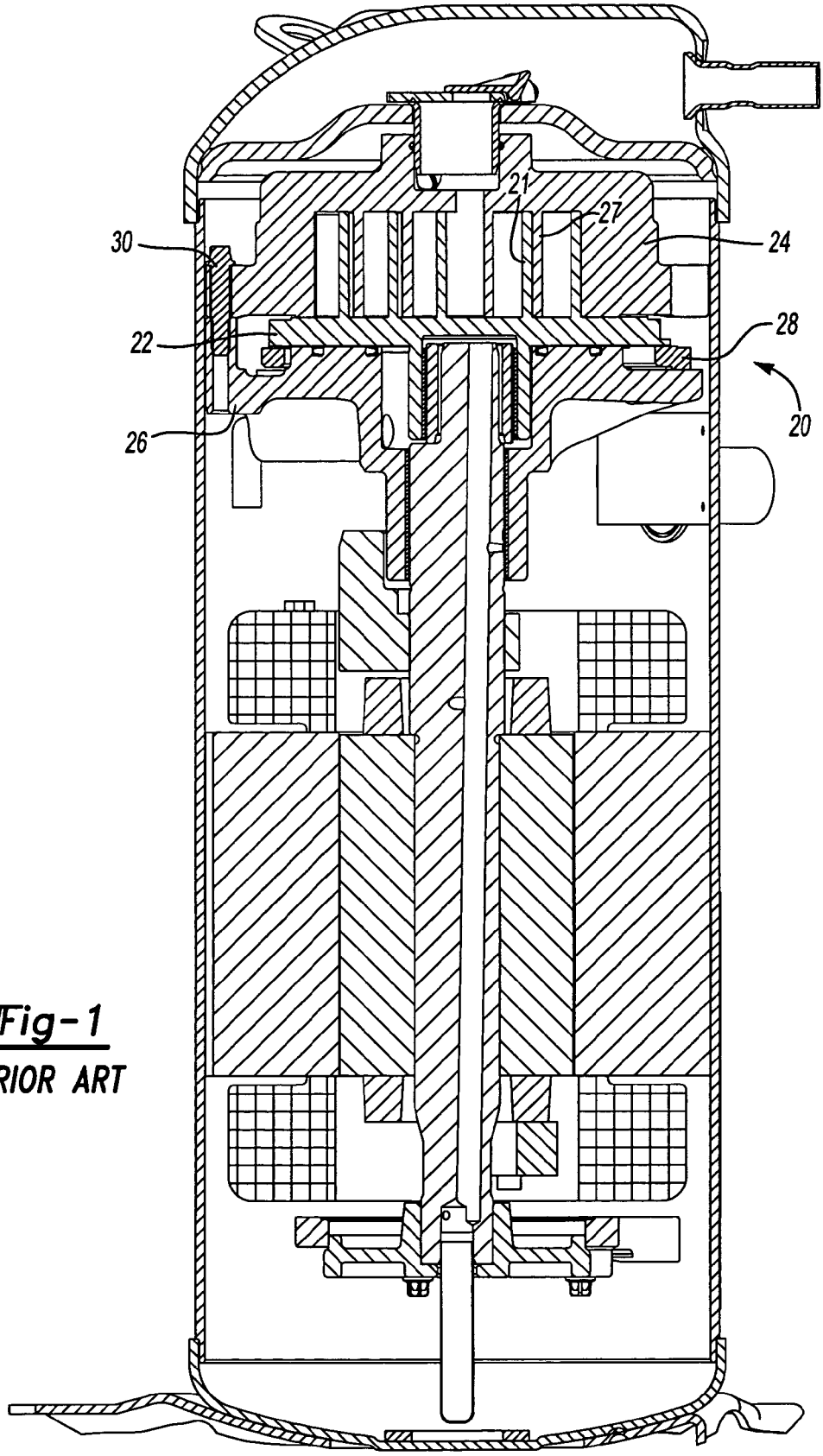
Fig-1 PRIOR ART
FIG. 1 is a cross-sectional view of a known scroll compressor.

As shown in FIG. 1, a scroll compressor 20 incorporates a fixed 24 and an orbiting scroll member 22. As is known, a crankcase 26 supports the non-orbiting scroll, and includes a non-rotation coupling 28, typically an Oldham coupling. As can be appreciated from FIG. 1, in the prior art, the fixed scroll was bolted to the crankcase by bolts such as shown at 30. As also shown, the fixed scroll has a generally spiral wrap 27, and the orbiting scroll has a wrap 21.

As mentioned above, in the prior art, it has been difficult to properly align the fixed scroll and the crankcase.

Figure 2:
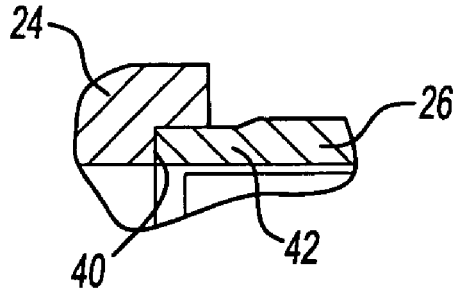
FIG. 2 shows an interlocking feature of the inventive scroll compressor.

As shown in FIG. 2, one feature of the present invention includes providing an alignment rabbet surface 40 on the fixed scroll outer periphery, and a mating surface 42 on the crankcase. The surface 42 is positioned within the rabbet 40 to properly position the two in the X-Y plane, or the plane perpendicular to the rotational axis of the drive shaft for the scroll compressor. Such positioning structure was generally known in the prior art, such as is shown in prior U.S. Pat. No. 6,270,328 owned by the assignee of this application.

The present invention improves upon this general X-Y structure by including a precision drilled hole.

Figure 3:
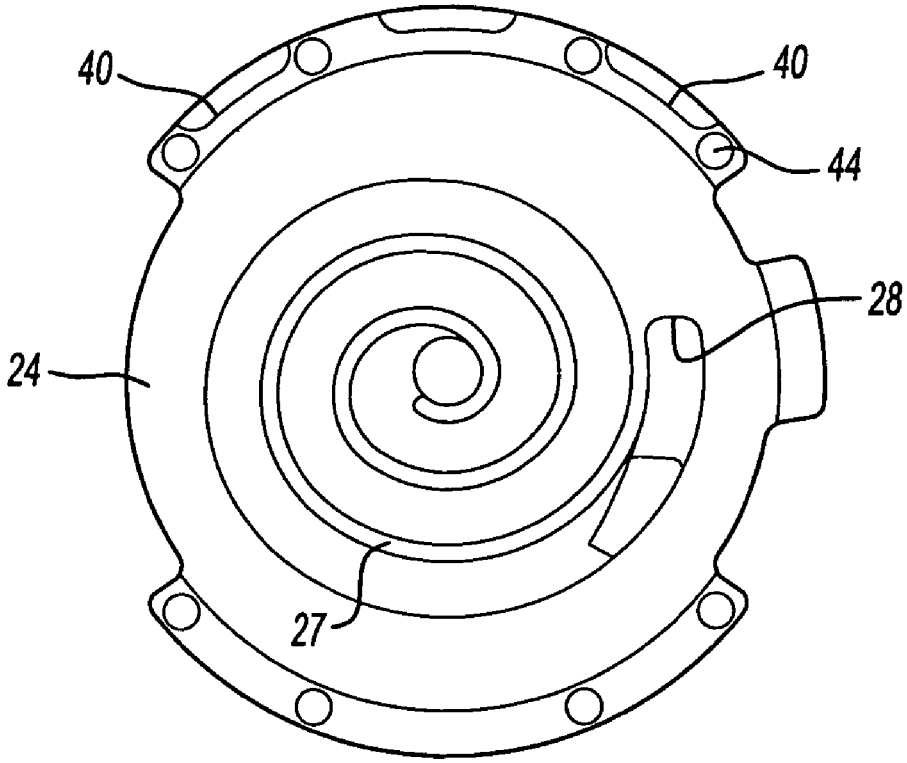
FIG. 3 is an end view of a fixed scroll incorporating the present invention.

As shown in FIG. 3, a general datum point 28 is known as the "C point" and includes the surface point upon which the scroll wrap 27 is machined from the remainder of the material for forming the fixed scroll 24. From this same C point 28, the rabbet surfaces 40 are also machined. In addition, and importantly for this invention, a hole 44 is precision drilled based upon its position relative to the C point 28.

Figure 4:
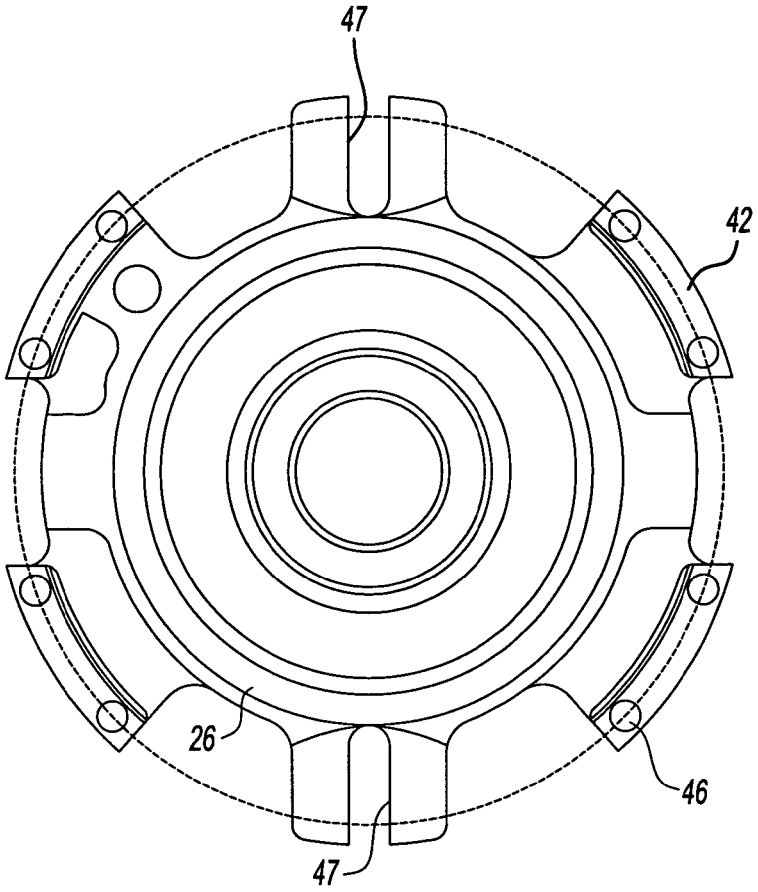
FIG. 4 is an end view of a crankcase incorporating the present invention.

FIG. 4 shows the crankcase 26. The crankcase 26 has slots 47 for receiving a portion of the Oldham coupling. The slots 47 are machined relative to the surfaces 42. A precision drilled hole 46 is generated at the same time the slots 47 are machined. Thus, and similar to the hole 44, by drilling the hole 46 at the time the slots 47 are machined, the scroll compressor designer can ensure that the hole 46 is in an exact position relative to the slots 47.

Figure 5:
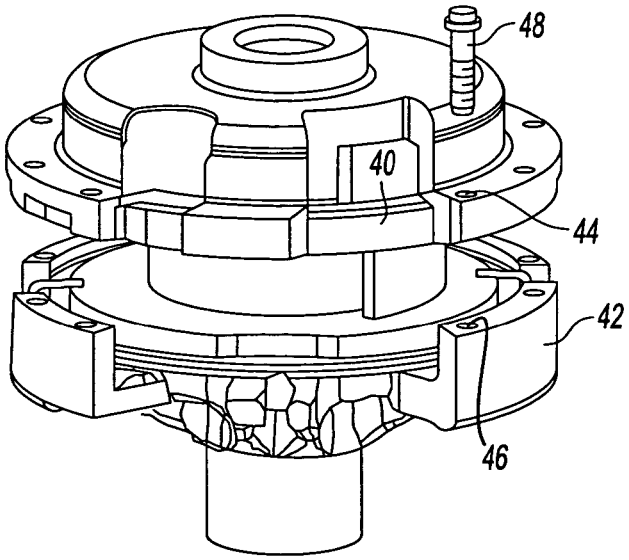
FIG. 5 is an assembly view of the inventive combination of the crankcase and fixed scroll.

As shown in FIG. 5, now, since the holes 44 and 46 are precision drilled relative to the datum points on their respective members, one knows that when the holes 44 and 46 are aligned, the non-orbiting scroll 24 and the crankcase 26 will be properly positioned relative to each other. When the bolt 48 has been driven into the holes 44 and 46, one is ensured that the non-orbiting scroll 24 and the crankcase 26 are properly aligned. The aligned holes 44 and 46, combined with the alignment surfaces 40 and 42, ensure the exact and proper position of the fixed scroll 24 relative to the crankcase 26. Moreover, since the datum for the crankcase 26 is the slot 47 for the Oldham coupling, one is also ensures that the Oldham coupling, and hence the orbiting scroll, will be in the proper position relative to the fixed scroll.

The present invention thus provides a very simple, yet effective method of aligning the non-orbiting scroll to the crankcase.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of aligning a pump cartridge for a scroll compressor comprising the step of:

(1) forming a non-orbiting scroll to have a scroll wrap formed from a datum point, and further forming a precision drilled hole at a particular location relative to said datum point;

(2) forming a crankcase by machining slots to receive a portion of a non-rotation coupling, and forming a precision drilled hole at a precise location relative to said slots;

(3) positioning said crankcase in contact with said non-orbiting scroll, and aligning said precision drilled holes of said non-orbiting scroll and said crankcase, and inserting a threaded fastener into said precision drilled holes to properly orientate said crankcase to said non-orbiting scroll.

2. A method as set forth in claim 1, wherein said non-orbiting scroll and said crankcase are further formed to have alignment surfaces, said alignment surfaces pre-positioning said crankcase to said non-orbiting scroll prior to the insertion of said threaded fastener.

3. A method as set forth in claim 1, wherein said precision hole is drilled into said non-orbiting scroll relative to a C-datum point from which said wrap is formed.

4. A method of aligning a pump cartridge for a scroll compressor comprising the step of:

(1) forming a non-orbiting scroll to have a scroll wrap formed from a datum point, and further forming a precision drilled hole at a particular location relative to said datum point, forming alignment surfaces on said non-orbiting scroll, and said precision hole being drilled into said non-orbiting scroll relative to a C-datum point from which said wrap is also formed;

(2) forming a crankcase by machining slots to receive a portion of a non-rotation coupling, and forming a precision drilled hole at a precise location relative to said slots, said crankcase being formed to have alignment surfaces;

(3) positioning said crankcase in contact with said non-orbiting scroll, by initially aligning said alignment surfaces on said crankcase and said non-orbiting scroll, and then aligning said precision drilled holes of said non-orbiting scroll and said crankcase, and inserting a threaded member into said precision drilled holes to properly orientate said crankcase to said non-orbiting scroll.

* * * * *